United States Patent [19]

Hultgren et al.

[11] 4,135,433

[45] Jan. 23, 1979

[54] LOADING DEVICE FOR A FIREARM

[75] Inventors: K. Sten R. Hultgren; J. P. Göran Sundmar, both of Karlskoga, Sweden

[73] Assignee: Aktiebolaget Bofors, Bofors, Sweden

[21] Appl. No.: 778,286

[22] Filed: Mar. 16, 1977

[30] Foreign Application Priority Data

Mar. 31, 1976 [SE] Sweden ..... 7603850

[51] Int. Cl.[2] ..... F41F 9/06

[52] U.S. Cl. ..... 89/47

[58] Field of Search ..... 89/33 A, 33 B, 45, 46, 89/47

[56] References Cited

U.S. PATENT DOCUMENTS

| | | | |
|---|---|---|---|
| 3,710,684 | 1/1973 | Brint | 89/47 |
| 3,906,651 | 9/1975 | Vesamaa | 42/25 |

FOREIGN PATENT DOCUMENTS

| | | | |
|---|---|---|---|
| 292682 | 6/1928 | United Kingdom | 89/47 |
| 466554 | 5/1937 | United Kingdom | 89/47 |

*Primary Examiner*—Stephen C. Bentley

*Attorney, Agent, or Firm*—Pollock, Vande Sande & Priddy

[57] ABSTRACT

An assembly for loading a projectile and a propellant charge into a barrel chamber of a firearm, wherein the projectile is movable from a first position at the side of a plane extending along an axis of the barrel to a second position coinciding with the barrel axis, and a rammer head assembly which pivots the propellant charge into line behind the projectile and drives the projectile and propellant charge into the firearm.

5 Claims, 8 Drawing Figures

A–A
B–B
C–C
14a
14a
11
25
27
27
25
24
26
26
25

A
A
B
B
C
C
10
10a
23
22
24
12'
25
11

LOADING DEVICE FOR A FIREARM

BACKGROUND OF THE INVENTION

The present invention relates to a loading device for a firearm, wherein a unit in the form of a projectile, shell etc. and/or a propellant charge, of the type carried in a cartridge case, propellant charge in bag, etc., is movable from a first position at the side of a barrel of the firearm or an extension of the axis of a bore of the barrel, to a second position coinciding with said extension, and is also movable to a ramming position or the like in the firearm.

In large-calibre field artillery weapons, a rapid loading process is desirable in order to maintain a high rate of fire over an extended period of time. Known field artillery weapons should be capable of a high angle of elevation, which in cases where the firearm has a low position in relation to the ground surface, results in a limited space being available behind the firearm for the loading function to be carried out

SUMMARY OF THE PRESENT INVENTION

The present invention is primarily concerned with the above discussed problems, and provides a novel embodiment in which the loading procedure can be automatized to a high degree although the embodiment is itself of a simple design. Through the use of the new loading device, the space factor will not become critical during operation of the firearm.

A novel feature of the loading device according to the present invention is that it comprises a rammer head assembly designed to support a loading unit and that the combination rammer and carrying member is rotatably arranged in a rammer car or the like which runs in the longitudinal direction of the barrel of the firearm.

BRIEF DESCRIPTION OF THE DRAWINGS

A preferred embodiment of a loading device according to the present invention will be described in the following, with reference to the accompanying drawings, in which.

DETAILED DESCRIPTION OF A PREFERRED EMBODIMENT

Figure 1:
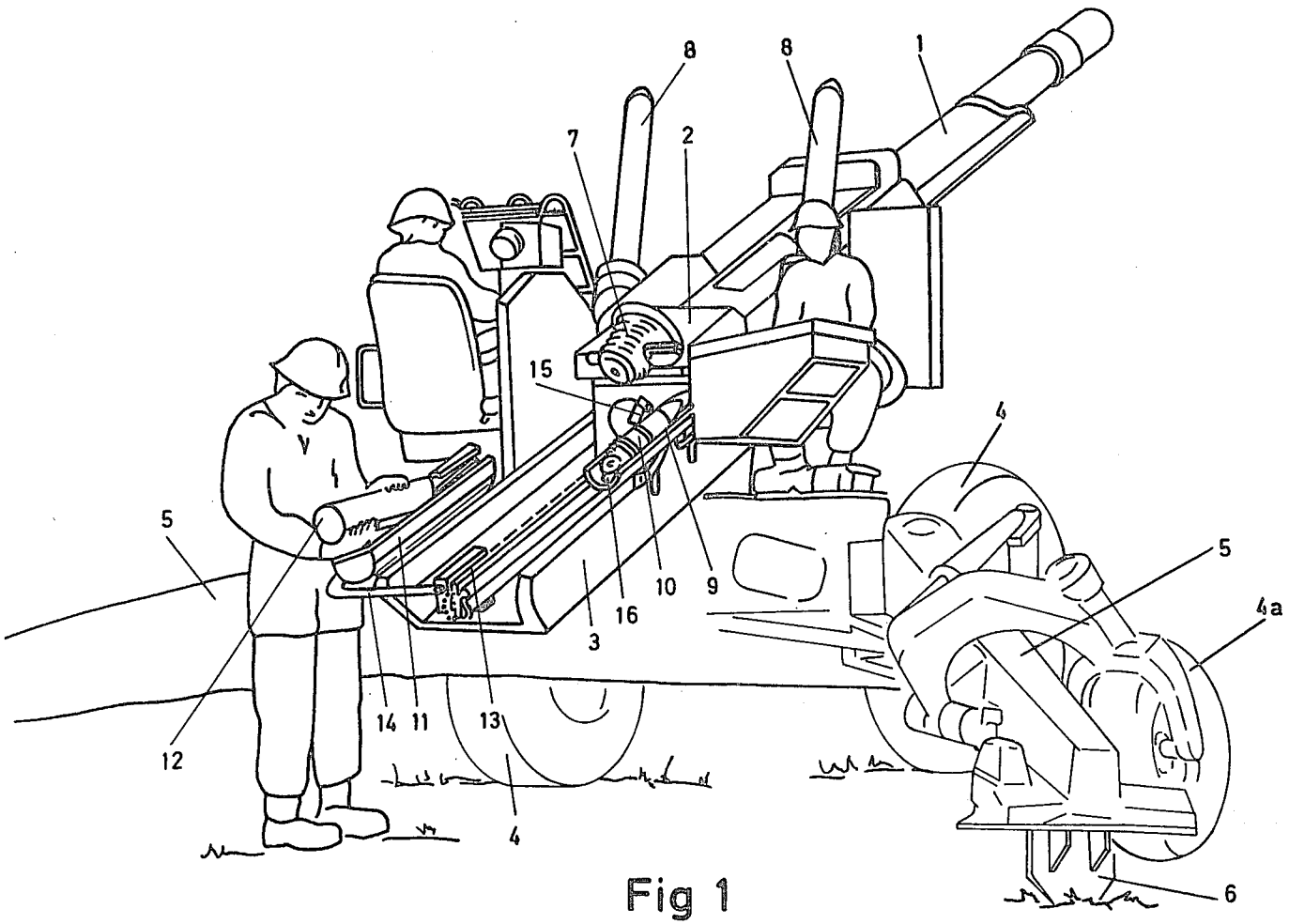
FIG. 1 shows an oblique perspective of a field artillery weapon utilizing the present invention.

FIG. 1 shows a field artillery weapon which is, in itself know, and which is provided with a barrel designated 1 and a breech ring designated 2. The firearm is provided with a cradle 3 positioned in a known manner, with the barrel 1 sliding on guide rules when it carries out its recoiling movement. The weapon travels on wheels, and is therefore provided with a pair of driving wheels 4, and positioned on a carriage trail 5 there are pivot wheels designated 4*a* which can be raised and lowered and which can pivot freely in the lowered position. In FIG. 1, the carriage trails 5 are spread and fixed to the ground via trail spades 6 when the weapon is in the firing position. At the rear part of the breech ring 2 a closing unit is arranged. In the preferred embodiment the closing unit comprises a screw mechanism 7 including cover and a chamber screw supported therein, which are of conventional design. For opening and closing of the breech mechanism, a conventional so-called semi-automatic device may be used. The elements controlling elevation of barrel 1 are designated 8.

A loading assembly is arranged at the rear of cradle 3 to provide for a rapid and automatic loading procedure. The loading assembly comprise a loading tray 9 for receiving and transferring a projectile or shell 10, into proper loading position. The loading tray 9 is locked to the elevating mass and can be laterally swung in and out in relation to the longitudinal direction of the firearm, with the swinging motion taking place in the plane of the loading tray 9. In the position shown in FIG. 1, the loading tray 9 has received a projectile 10, and must be swung until the axis of rotation of the projectile coincides with the axis of the bore of the barrel 1, not shown. The loading assembly also comprises a carrying member 11 which supports a propellant charge 12 positioned in a cloth bag or the like, filled with powder, and having a cylindrical form. The carrying member 11 for the propellant charge forms a rammer head attached to a rammer car 13 of a conventional type, with the running movement of car 13 being geared to achieve high loading speed. The combination rammer and carrying member 11 consists of a cradle-formed unit and an attached arm 14, which includes an end is rigidly fastened to the cradle-formed unit and includes a further end rotatably supported in rammer car 12. This allows the cradle-formed unit to rotate laterally along an arc-shaped line between the first position receiving the propellant charge and shown in FIG. 1, and a second position coinciding with extension of the box axis. The rammer car 13 can be run inside the cradle 3 in the longitudinal direction of the firearm between an end position shown in FIG. 1 and an advanced position in which the propellant charge is properly positioned in the chamber of the barrel 1 behind the projectile 10. The preferred embodiment provides, without any risk of impeding the recoil of the firearm, a loading assembly which is of a limited extent in the longitudinal direction of the firearm, which makes it possible to achieve high angles of elevation (for instance up to 70°) of barrel 1.

At the breech ring 2, a charge retainer 15 for the propellant charge 12. The charge retainer 15 provides a spring action allowing the projectile 10 and propellant charge 12 to be inserted in the chamber of the barrel 1, and functions to ensure that the propellant charge 12 will achieve the correct longitudinal position in the barrel 1 after the combination rammer and carrying member 11 is retracted and screw mechanism 7 is closed into position. The loading tray 9 is made with a spring-action stop 16, which prevents projectile 10 from sliding rearwardly off the loading tray 9 when the firearm assumes high angles of elevation.

Figure 2:
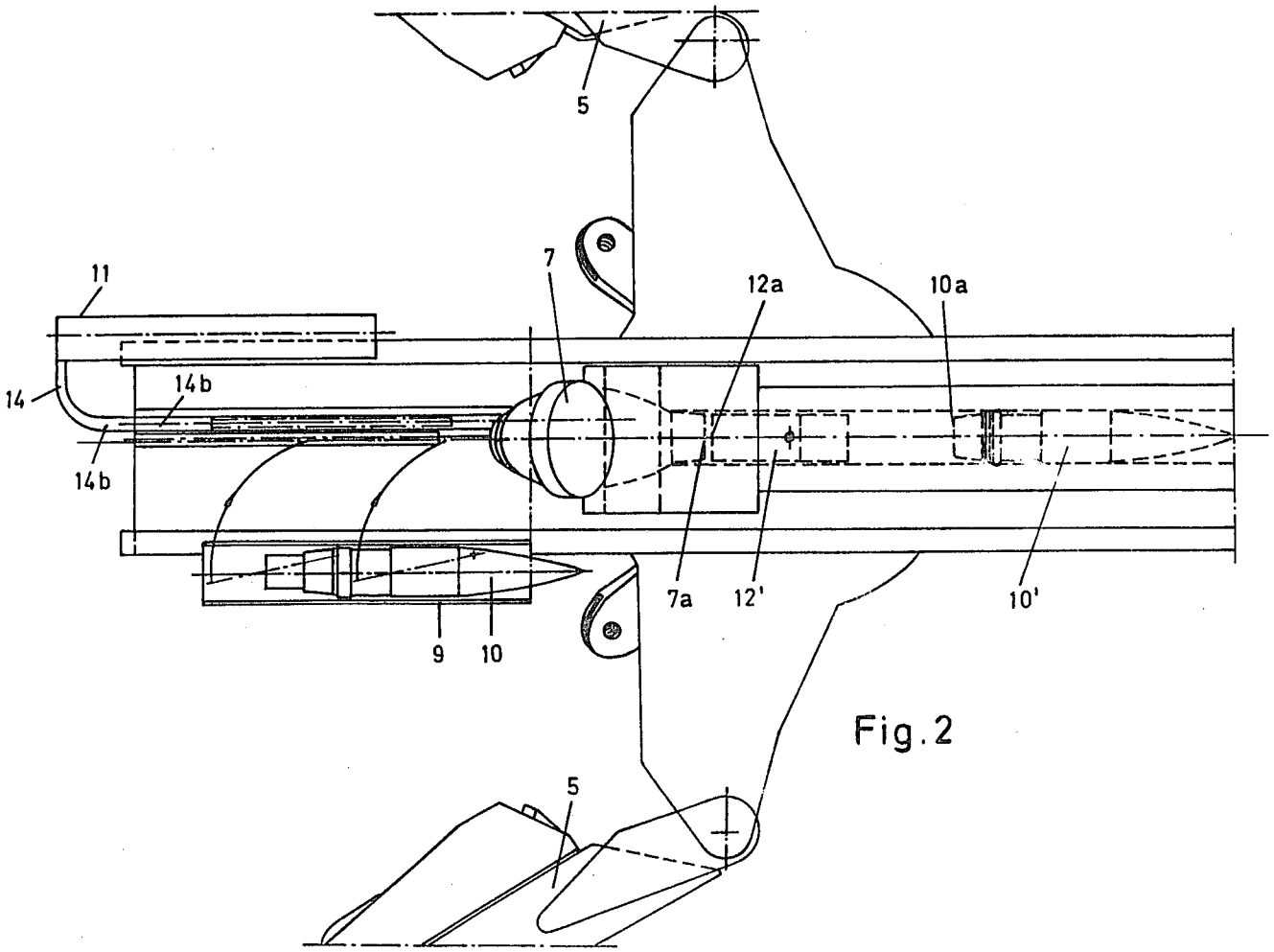
FIG. 2 shows in a horizontal view the weapon according to FIG. 1.

In FIG. 2, arrows show an arc for swinging movement of the loading tray 9 from a side or receiving position to a position coinciding with the axis of the bore. Likewise, the position of projectile 10 in the bore of the barrel at the origin of the rifling is designated at 10. In a corresponding way, the firing position of the propellant charge 12 is designated 12'. The propellant charge 12 can assume various lengths depending on the amount of charge used, as indicated in FIG. 1 by the dashlines and, except when it assumes a maximum length, it does not fill up the entire space between an obturating surface 7a (shown with dash lines in the position its assumes when the screw mechanism is closed) of the screw mechanism and the rear surface 10a of the shell or projectile. It is essential that the propellant charge 12 be placed in the chamber so that one of its end surfaces 12a comes close to or against the surface 7a of the screw mechanism. Otherwise, an unacceptable dispersion of the various projectiles would be obtained.

Figure 3:
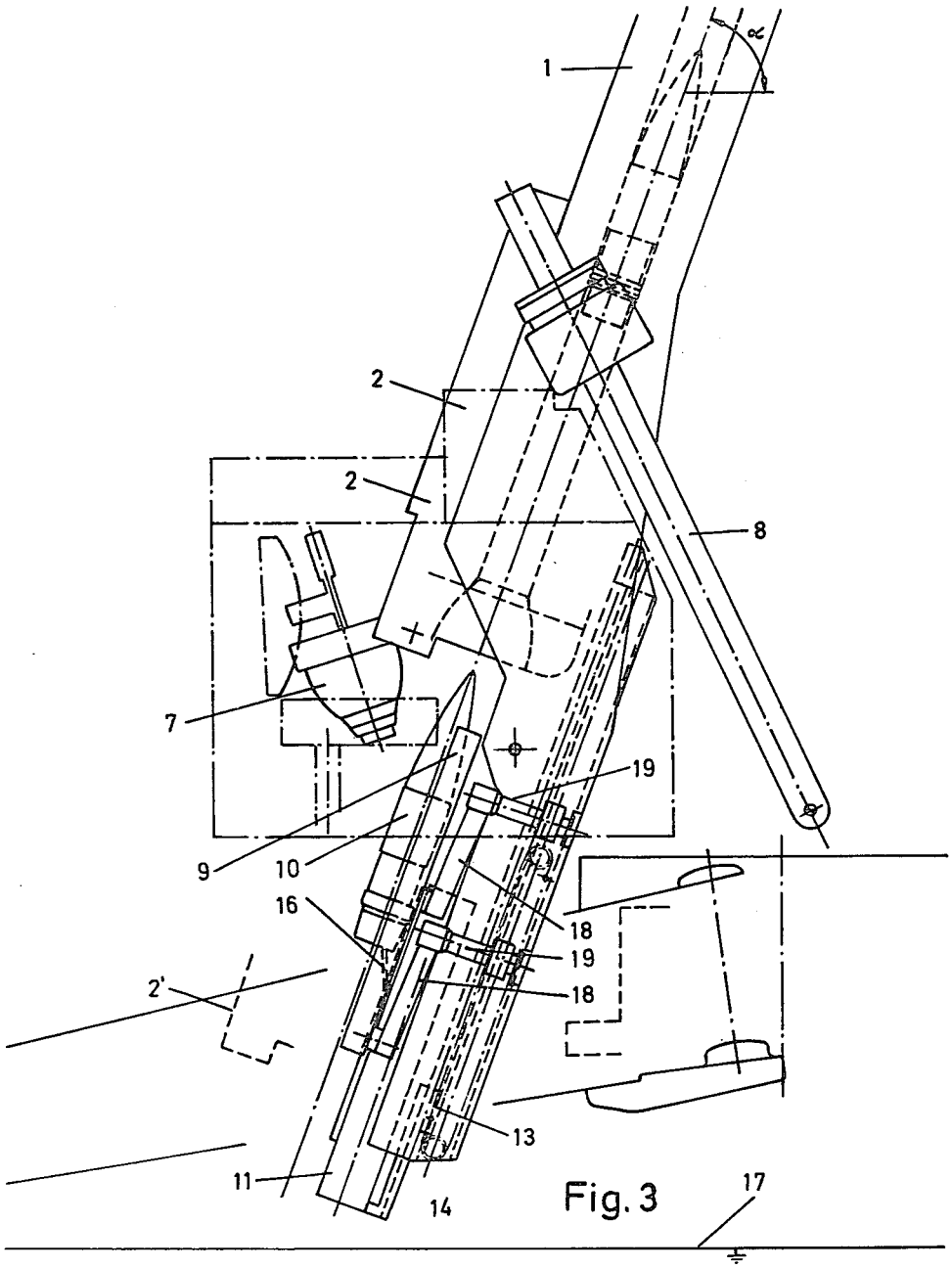
FIG. 3 shows a side view of the weapon according to FIG. 1, when in the maximum angle of elevation.

FIG. 3 is intended to show parts of the preferred embodiment wherein the firearm is in the maximum angle of elevation $\alpha = 70°$. The fully recoiled position of the firearm is designated 2', and it will be noted that it becomes necessary that the combination rammer and carrying member 11 and the loading tray 9 be swung aside to avoid striking the ground surface designated at 17.

Figure 4:
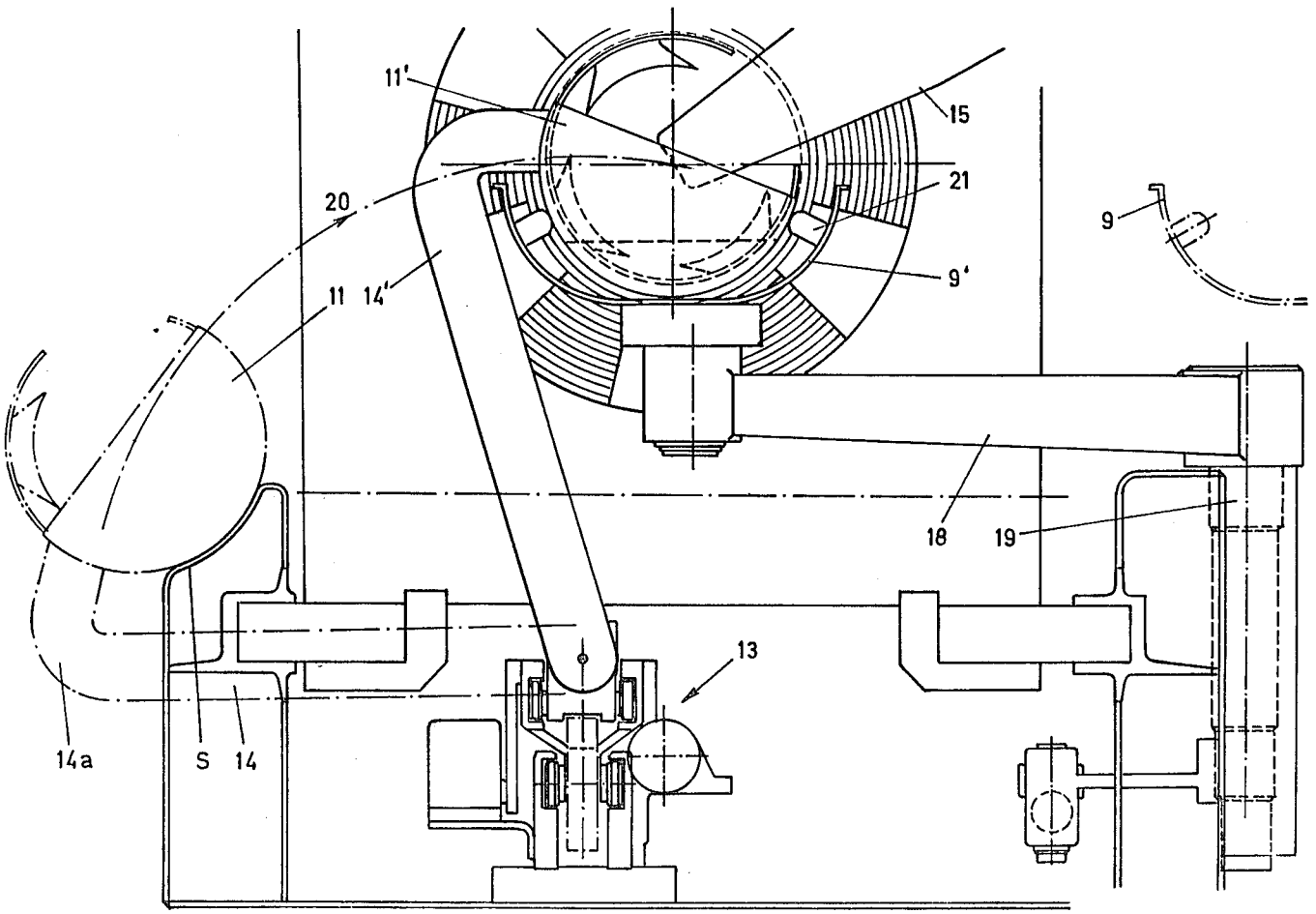
FIG. 4 shows an end view from the rear of the field artillery weapon according to FIG. 1, when engaged in the loading procedure.
Figures 5A, 5B, 5C, 5D:
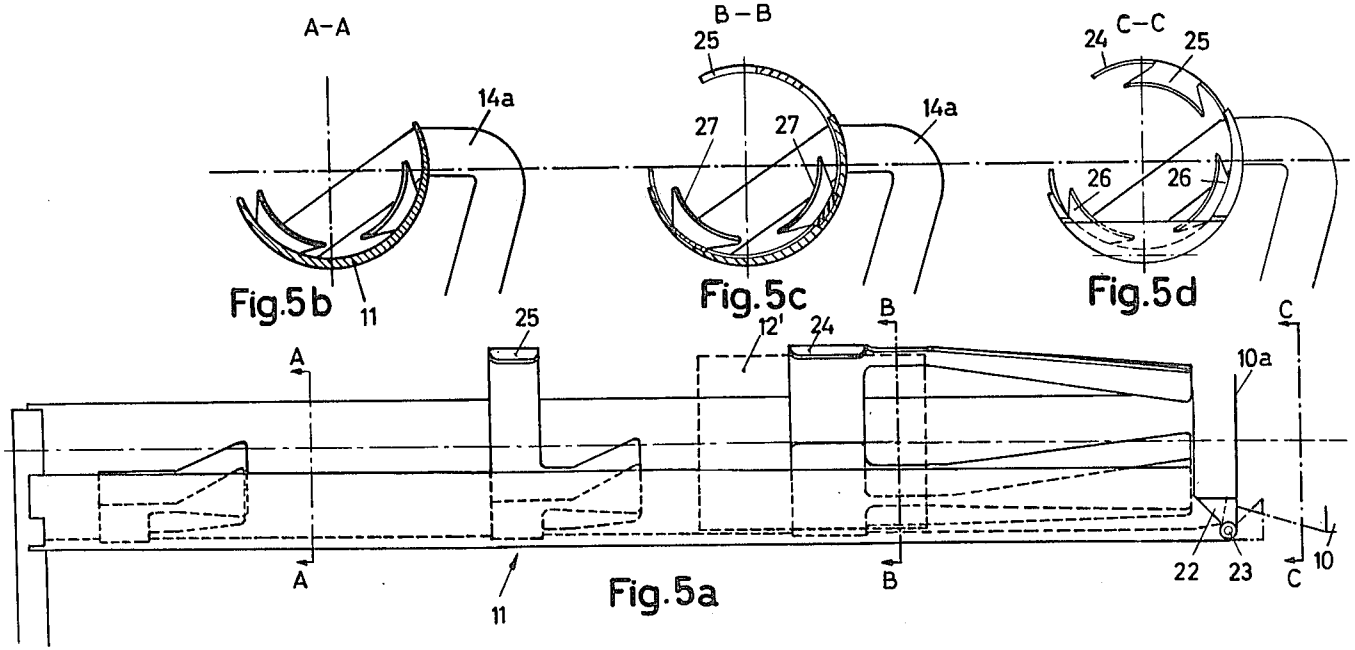
FIG. 5*a* shows a side view of a unit according to FIG. 4.
FIGS. 5*b*-5*d* show in various views portions of the invention according to to FIG. 5*a*.

FIG. 4 shows the case when the loading tray 9 is swung into its second position 9' in line with the bore axis. The loading tray 9 is supported in a know way on two parallel arms 18, of which only one is shown in FIG. 4, while both arms are shown in FIG. 3. The arms 18 are rotatably attached to an underside portion of loading tray 9, and also are fixed to supports 19, so that loading tray 9 can be displaced to a parallel lateral position by swinging in its own plane. In FIG. 4, the cradle-formed carrying member 11 and the arm 14 achieve positions designated 11' and 14' respectively in the extension of the axis of the bore, with the carrying member being moved along an arc-shaped line 20. As assembly 11 is swung to position 11, the front parts are moved down into the rear portion of loading tray 9, which like the remaining portion of the loading tray is designed to permit insertion of assembly 11. The loading tray 9 also has internally directed guide rails 21, extending in the longitudinal direction of loading tray 9. When the unit 11 is moved down into the loading tray 9, the propellant charge 12 inserted in the unit 11 will come into a position behind the projectile 10 already in the loading tray 9. The arm 14, which is rigidly fastened to the unit 11 includes an angular fastening part 14a which permits arm 14 to extend over one side edge of tray 9 during positioning of assembly 11 which can thereby be given the same height as the other side edge of the loading 9. Arm 14 is rotatably fastened to rammer car 13 through an angular section 14b.

Carrying member 11 has the cross-sectional form of a circular tube which has been cut in half along its longitudinal direction, with a rear end wall. In the position designated 11 in FIG. 4, the opening of member 11 is turned somewhat towards the person who is inserteing the propellant charge 12, while in the position designated 11' the opening is turned somewhat away from the same person. The outside of member 11 coacts with a supporting part S which has been given a shape corresponding to an abutting section of member 11. In this way, the combination rammer and carrying member assumes a defined side position. The charge retainer 15 is arranged interaction with member 11 when in the second position 11'.

In the position depicted, according to FIG. 4, member 11 is intended to be longitudinally displaced in relation to the surrounding loading tray 9, on the guide rails 21, i.e., at right angles to the plane of the FIG. 4. The displacement of member 11 is actuated by rammer car 13 via connecting arm 14. During forward movement, member 11 contacts the projectile 10 in the loading tray 9, and moves the projectile in front of itself so that the projectile 10 slides off the loading tray 9 and into its position in the bore of the barrel 1. At the same time, the remaining propellant charge 12 supported in member 11 is forced into a position behind the projectile 10 in the chamber of the barrel 1, as shown in FIG. 3. The guiding of the rammer car 13 can take place in a conventional way which is known in, and the in and out swinging motion of the combination rammer and carrying member 10 as well as the loading tray 9 can be carried out in a known way.

A comparatively high ramming speed of up to approx. 4 m/s, can be achieved with member 11 actually stopping before the projectile 10 reaches its firing position in the bore of the barrel 1. From the stopped position, the projectile 10 continues via free flight to its firing position, using the kinetic energy obtained from member 11.

The carrying member 11 is shown in more detail in FIGS. 5a–5d, and is provided with a part 22 which can be turned down, but which normally is turned up, for instance by means of a spring which may be attached at a support 23 (not shown). In its turned-down position, part 22 has the position designated 22' in FIG. 5a. In the turned-up position, member 11 coacts with the rear surface 10a of the projectile 10 via the part 22, with part 22 forcing a projectile 10 to move forwards (to the right in FIG. 5a). The part 22 can be actuated to the turned-down position 22' by contact with propellant charge 12' inserted in member 11 and slidable in a forward direction to follow projectile 10 into the firing chamber. As regards the preferred embodiment of part 22, in certain cases (for instance at high ramming speeds) it is advisable to have part 22 made so that it can coact with the shell 10 at several points or surfaces along the periphery of the rear surface 10a of shell 10, which points or surfaces can be advantageously, diametrically opposite each other. The positions of part 22 may be guided by shell 10 and propellant charge 12 without the need for any special springs in the support 23.

Member 11 includes spring-action members for securing the propellant charge 12 so that this will not strike the rear surface of the projectile 10 or part 22 during loading of the firearm with too hard a force. Too hard a striking force can result in the propellant charge 12 being damaged. However, the spring-action members permit the retaining of propellant charge 12 when this coacts with the charge retainer 15 at the subsequent rearward movement of the unit.

The spring-action members comprise a first and a second holder 24 and 25, respectively, each of which has the form of a band which extends in the transversal direction along an assumed extension of a circular cross-section so that each band can extend partly over portions of the propellant charge 12 not covered by member 11. The holders are provided with spring elements 26 and 27, respectively, extending in a forwardly direction, which be fastened directly in the inside of member 11. The spring elements 26 and 27 can be arranged two and two or three and three with different lengths and with the respective spring elements being forwardly and inwardly inclined. The spring elements 26 and 27 are made of spring steel or the like.

The length of member 11 is adapted to the length of the particular firing chamber and the possibility of ramming the projectile or shell 10 with said free flight into the chamber's firing position so that good ramming will be obtained in the origin of the rifling even at high elevations.

When the combination rammer and carrying member 11 has been pulled back or to the left, in FIG. 2 from its farthest advanced position by movement of rammer car 13, the propellant charge 12 makes contact with the charge retainer 15, after possibly, depending on its length having accompanied member 11 a certain distance in the rearward dirction of the firearm. The charge retainer 15 which then coacts with the rear cylindrical surface of the propellant charge 12, insures that the propellant charge 12 achieves a certain longitudinally displaced position in the firing chamber. This position is determined in such a way that the surface *7a* of closing mechanism 7 is positioned close to a surface of chamber 12. It is then essential that the closing mechanism 7 operates with a gentle movement whereby the propellant charge 12 is not thrown forwards when the closing mechanism 7 is closed. The rammer car 13 continues to its starting end position, with member 11 moving to one side, in order to avoid recoil of the forearm. After member 11 has moved rearwardly from the advanced position to its starting position, the loading tray 9 is actuated so that it is moved to a side of the forearm simultaneously with the movement of member 11. The charge retainer 15 is of a conventional design, and gives way for the projectile and the propellant charge 12 as they are inserted into the firing chamber by the combination rammer and carrying member 11. The charge retainer 15 also gives way, in a way which is known in itself, during closing of the screw mechanism 7 when it comes into a position between the closing part in question. The charge retainer 15 is arranged in one of the sections of screw mechanism 7 in which there are no threads. In its turned-out position the charge retainer 15 withstands forces directed from the inside of the barrel 1 and outwards, permitting the propellant charge 12 to be removed from member 11. The charge retainer 15 may assume the form of a flat spring suspended in a hinge with a built-in stop which defines the turned-out position of the charge retainer 15. In the turned-in position the charge retainer 15 also coacts with a moving-out spring in the closing mechanism. Through the design shown of member 11 and the loading tray 9, member 11 is guided up onto the guide rails 21 of the loading tray 9, which counteracts the spring-action phenomenon in the unit 11 when this supports a heavy shell (12 kg).

The invention is not limited to the embodiment shown above as an example, but can be subject to modifications within the scope of the following claims. Thus, for instance, ammunition other than the ammunition shown can be loaded with the loading members in question.

We claim:

1. An assembly for loading a projectile and a separate propellant charge into an artillery-type firearm, comprising:

a rammer assembly including a carrying member having a curved cross-section for supporting said propellant charge in axial alignment with said separate projectile;

a rammer car positionable in a longitudinally extending cradle of said firearm; and means extending between said rammer car and said rammer assembly for swinging said carrying member along an arc-shaped curve between a first position with an axis extending axially through a barrel of said firearm.

2. An assembly according to claim 1, wherein a loading tray is pivotally attached to said firearm for supporting said projectile in a position coinciding with said axis and between said barrel and said propellant charge mounted on said carrying member.

3. An assembly according to claim 2, wherein a portion of said carrying member engages a surface of said projectile when said carrying member and said loading tray are aligned behind said firearm barrel;

whereby movement of said carrying tray forces said projectile to enter said barrel.

4. An assembly according to claim 3, wherein said carrying member is arranged to slide over a portion of said loading tray while forcing said projectile to enter said barrel.

5. An assembly according to claim 1, wherein said means comprises a support shaft extending from said carrying member into pivotal engagement with said rammer car.

* * * * *

UNITED STATES PATENT AND TRADEMARK OFFICE

CERTIFICATE OF CORRECTION

PATENT NO. : 4,135,433

DATED : January 23, 1979

INVENTOR(S) : Hultgren et al

It is certified that error appears in the above-identified patent and that said Letters Patent are hereby corrected as shown below:

Col. 6, line 23, before the word "with" insert --at a side of said firearm and a second position coinciding--

Signed and Sealed this

*Third* Day of *June 1980*

[SEAL]

*Attest:*

SIDNEY A. DIAMOND

*Attesting Officer*

*Commissioner of Patents and Trademarks*